US010486328B2

(12) United States Patent
Wagner et al.

(10) Patent No.: US 10,486,328 B2
(45) Date of Patent: Nov. 26, 2019

(54) METHODS AND SYSTEMS FOR FASTENING BED FOUNDATIONS

(71) Applicant: Palletec, LLC, Fridley, MN (US)

(72) Inventors: Paul Howard Wagner, Columbia Heights, MN (US); James Thomas Kirk, Hastings, MN (US); Jon Denney, Grand Rapids, MN (US); Marcus Keith Drayton, Roseville, MN (US)

(73) Assignee: Palletec, LLC, Fridley, MN (US)

( * ) Notice: Subject to any disclaimer, the term of this patent is extended or adjusted under 35 U.S.C. 154(b) by 176 days.

(21) Appl. No.: 15/488,877

(22) Filed: Apr. 17, 2017

(65) Prior Publication Data

US 2018/0215067 A1 Aug. 2, 2018

Related U.S. Application Data

(60) Provisional application No. 62/452,401, filed on Jan. 31, 2017.

(51) Int. Cl.

| | |
|---|---|
| ***B27F 7/00*** | (2006.01) |
| ***B27M 3/00*** | (2006.01) |
| ***B27F 7/02*** | (2006.01) |

(52) U.S. Cl.

CPC ..... *B27F 7/003* (2013.01); *B27F 7/006* (2013.01); *B27F 7/02* (2013.01); *B27M 3/0073* (2013.01);

(Continued)

(58) Field of Classification Search

CPC .. B27F 7/003; B27F 7/006; B27F 7/02; B27F 7/09; Y10T 29/53317; Y10T 29/5109

See application file for complete search history.

(56) References Cited

U.S. PATENT DOCUMENTS 2,958,938 A * 11/1960 Nicklasson ..... B31D 5/00 29/241

3,261,527 A * 7/1966 Sterner ..... B27F 7/02 227/130

(Continued)

OTHER PUBLICATIONS

Viking Engineering & Development, Viking Service, Skute Parts Book, Dec. 2013, 37 pages, Viking Engineering & Development, Fridley, MN.

*Primary Examiner* — Jason L Vaughan

(74) *Attorney, Agent, or Firm* — Erik Swenson

(57) ABSTRACT

A fastening system includes a carriage moveably mounted to a frame between first and second positions extensive with and beyond a fixture. The fixture is horizontally movably mounted in the frame to receive components to be fastened of differing sizes, with slide bars vertically moveably mounted relative to the fixture and simultaneously horizontally movable with the fixture. Adjustable spacers, in the form of a body having different extents or telescopic pillars, are positioned in the frame to abut with the components received in the fixture. Wheels rotatably mounted to first and second platforms of the carriage are received in U-shaped channels of the frame, with the first and second platforms being moved by endless belts clamped thereto. Nail guns are movably mounted between vertical posts of the platforms and include a plunger which is biased against a drum carrying a belt of fasteners and include a flat board tangential to a roller having a V-shaped circumferential groove receiving the heads of nails. The slide bars are movable relative to the fixture by pivoting first and second links which are pivotably connected to each other.

19 Claims, 12 Drawing Sheets

(52) U.S. Cl.
CPC ..... *Y10T 29/5109* (2015.01); *Y10T 29/53317* (2015.01)

(56) References Cited

U.S. PATENT DOCUMENTS 3,273,776 A * 9/1966 Bryson ..... B27F 7/02 227/109
3,557,439 A * 1/1971 Dykeman ..... B27M 3/0073 29/430
3,591,067 A * 7/1971 Vial ..... B27M 3/0073 227/84
3,755,871 A * 9/1973 Nelson, Jr. ..... B27M 3/0073 227/100
3,763,547 A * 10/1973 Blakeslee ..... B27M 3/0073 227/45
3,945,549 A 3/1976 Colson
3,968,560 A * 7/1976 Vial ..... B27M 3/0073 29/430
4,054,236 A * 10/1977 Paxton ..... B27F 7/02 227/100
4,077,106 A * 3/1978 Lichtenstein ..... B27M 3/0013 227/152
4,168,566 A * 9/1979 Streckert ..... B27M 3/0073 227/45
4,204,624 A * 5/1980 Gunn ..... B27F 7/02 227/101
4,235,005 A * 11/1980 James ..... B27M 3/0073 227/152
4,241,495 A * 12/1980 Wakeem ..... B23P 19/041 19/41
4,311,293 A * 1/1982 Tenniswood ..... F16G 13/16 248/49
4,392,600 A * 7/1983 Billett ..... B27M 3/0073 227/100
4,403,388 A * 9/1983 Belcher ..... B27M 3/0073 227/40
4,489,874 A * 12/1984 Worst ..... B27M 3/0073 144/136.6
4,492,016 A * 1/1985 Smets ..... B27M 3/0073 227/104
4,757,605 A * 7/1988 Richardelli ..... B27M 3/0073 227/142
4,782,989 A 11/1988 Wallin et al.
4,793,540 A * 12/1988 Mangan ..... B27M 3/0073 227/100
4,824,004 A * 4/1989 Hanson ..... B23P 19/04 227/152
4,867,364 A 9/1989 Wallin et al.
4,900,329 A * 2/1990 Richardelli ..... B27F 7/006 29/430
5,052,307 A 10/1991 Morrison
5,058,795 A * 10/1991 Tonus ..... B27M 3/0073 227/100
5,095,605 A * 3/1992 Tonus ..... B27F 7/003 227/152
5,108,350 A * 4/1992 Szpakowski ..... F16G 13/16 474/207
5,249,352 A * 10/1993 Landers ..... B27M 3/0073 227/111
5,312,022 A 5/1994 Thompson et al.
5,335,499 A 8/1994 Thompson et al.
5,375,315 A * 12/1994 Griffith ..... B23P 19/041 100/269.04
5,379,513 A * 1/1995 Thompson ..... B27F 7/006 227/45
5,555,617 A * 9/1996 Pope ..... B27M 3/0073 269/910
5,715,985 A 2/1998 Letson
5,984,621 A 11/1999 Letson
6,176,009 B1 * 1/2001 Inman ..... B27M 3/0073 29/429
6,499,206 B1 * 12/2002 Eure ..... B27M 3/0073 227/110
7,228,997 B1 * 6/2007 Thompson ..... B27F 7/09 227/110
2002/0104210 A1 * 8/2002 Buck ..... B27F 7/13 29/430
2007/0108682 A1 * 5/2007 Holliger ..... B23P 19/041 269/37
2008/0295708 A1 * 12/2008 Madgar ..... B27F 7/09 100/215

* cited by examiner

METHODS AND SYSTEMS FOR FASTENING BED FOUNDATIONS

BACKGROUND

Methods and systems for fastening components, such as bed foundations, are shown and described.

Generally, a bed foundation F includes first and second end rails E, first and second side rails R extending generally perpendicularly between opposite ends of end rails E, a center support C extending between first and second end rails E and spaced from and intermediate side rails R, and a plurality of cross slats S extending between first and second end rails E in a spaced, parallel relation.

It should be appreciated that bed foundations F come in different sizes of different lengths, widths, and heights. Thus, a need exists for methods and systems for fastening which minimize and reduce complexity of human involvement and which also are easily adjustable to allow fastening of components of different sizes.

SUMMARY

This need and other problems in the field of fastening components are solved by providing illustrative embodiments of methods and systems for fastening bed foundations. Specifically, a fastening system generally includes a fixture mounted on a frame, with the fixture adapted to hold a component to be fastened. In some aspects, the fixture includes squaring corners extending to a height above the frame. A nail gun carriage is moveably mounted to the frame and movable between a first position extensive with the fixture and a second position beyond the fixture. A nail gun is carried by the nail gun carriage and, in some aspects, at a consistent height relative to the frame and greater than the fixture height.

In certain aspects, an adjustable spacer is mounted on the frame and has an adjustable height intermediate the fixture height and the frame and adapted to abut the component held in the fixture. In particular, the adjustable spacer is positioned on the frame when adjusted to one of multiple extents corresponding to a depth of the component held in the fixture. Particularly, a body of a fixed shaped but having a height, a width, and a length of different extents can be oriented to have a different face abut with the frame and an opposing face abut with the component. Similarly, pillars are slideable, shown as being telescopic relative to each other, and connected to each other to define multiple extents, with the pillars having an extent corresponding to the component held in the fixture abutting with the frame.

In other aspects, the fixture is in the form of first and second support beams moveably supported between first and second side braces of the frame. First and second slide bars located intermediate and parallel to the first and second support beams are movably mounted to the first and second support beams and moveable relative to the first and second support beams. After being fastened, the component can be lifted from the first and second support beams by raising the first and second slide bars relative to the first and second support beams. The first and second support beams are moved, and can be simultaneously moved, relative to the first and second side braces of the frame to correspond to the component being fastened, with the first and second slide bars moving with the first and second support beams. Particularly, in one aspect, rotating an adjustment shaft threadably engaged in the first and second support beams having linear bearings slideably receiving linear bearing shafts extending between the first and second support braces moves the first and second support beams and the first and second slide bars mounted thereto.

In related aspects, the slide bars are moved by first and second links pivotably mounted together about an axis intermediate first and second ends of the links. The first ends of the first and second links are pivotably connected to opposite ends of the slide bars. The second end of the first link is pivotably mounted to a slide mechanism mounted to the support beam, while the second end of the second link is pivotably mounted to the support beam opposite to the slide mechanism. The first and second links are pivoted by a cylinder, which could be a three position cylinder, having ends connected to the first and second links.

In other aspects, the carriage includes wheels rotatably mounted to inner vertical edges of first and second platforms and received between first and second legs of U-shaped channels of the frame, for movably mounting the carriage to the frame. The nail gun is carried by and between vertical posts upstanding from the first and second platforms. Cables connected to the nail gun are carried by a flexible cable carrier having a C-shaped portion extending from a hanger connected to the platform opposite to the vertical post and an elongated portion parallel to the frame. The distance of the C-shaped portion from the hanger changes with movement of the platform relative to the frame. The carriage is moved by moving first and second endless belts clamped to the first and second platforms, with the platform being intermediate the endless belt and the hanger. An air reservoir can extend between the vertical posts of the first and second platforms providing rigidity and for supplying air to the nail gun.

In other aspects, a plunger is slideably biased towards and engages an outer circumference of a belt drum carrying a spool of fasteners. The heads of nails in a belt are received between a flat board extending tangentially to the cylindrical outer surface of a roller and a bottom of a circumferential V-shaped groove in the cylindrical outer surface of the roller, such that the flat board provides a stationary contact plane for the nails.

In still other aspects, the nail gun, includes a mount movably supported by a linear bearing slideably receiving a linear bearing shaft extending between the vertical posts of the first and second platforms. The nail gun is moved by rotating an adjustment shaft rotatably mounted between the vertical posts and threadably mounted to the mount.

DESCRIPTION OF THE DRAWINGS

The illustrative embodiments may best be described by reference to the accompanying drawings where.

Figure 1:
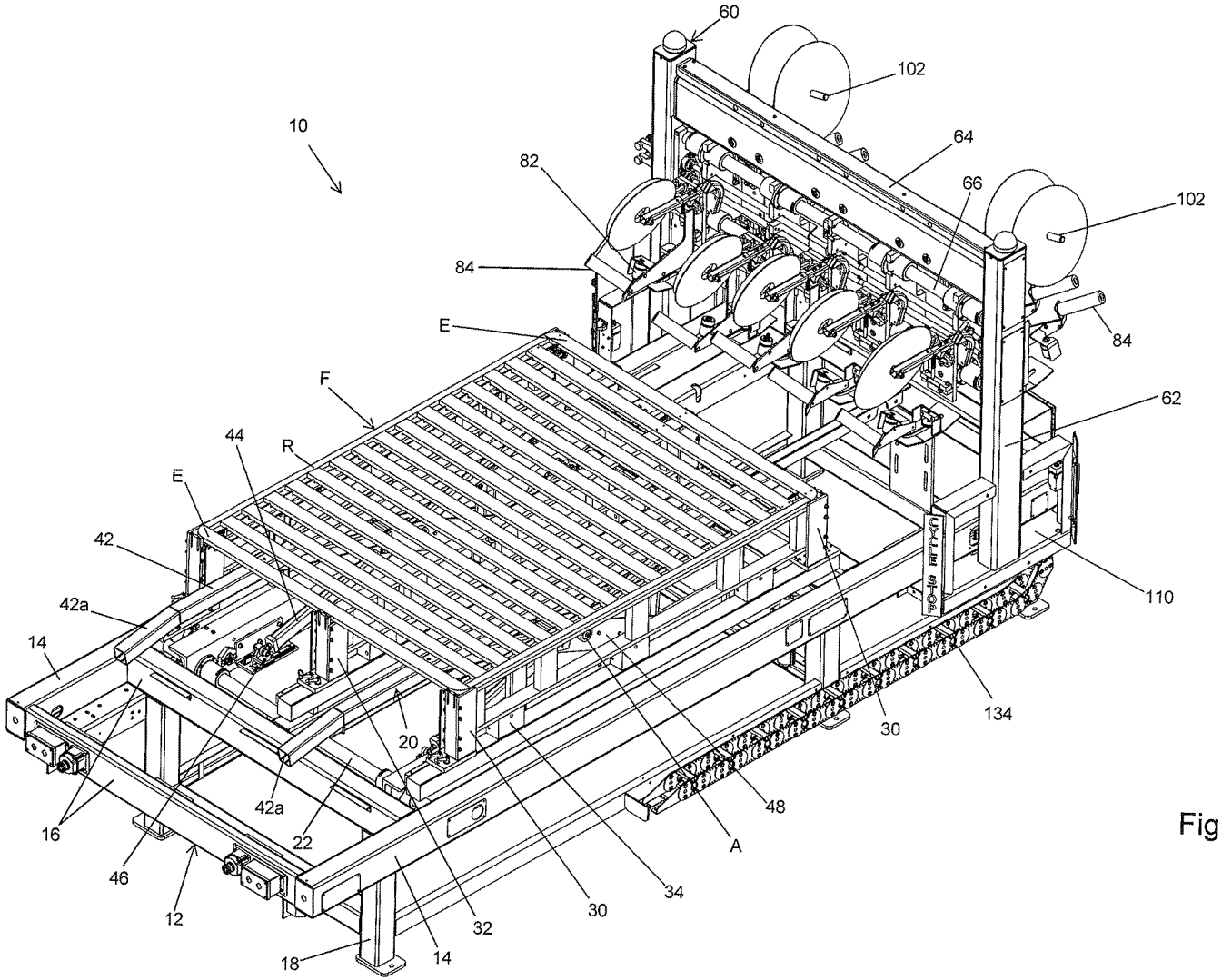
FIG. 1 shows a perspective view of a system for fastening bed foundations.
Figure 2:
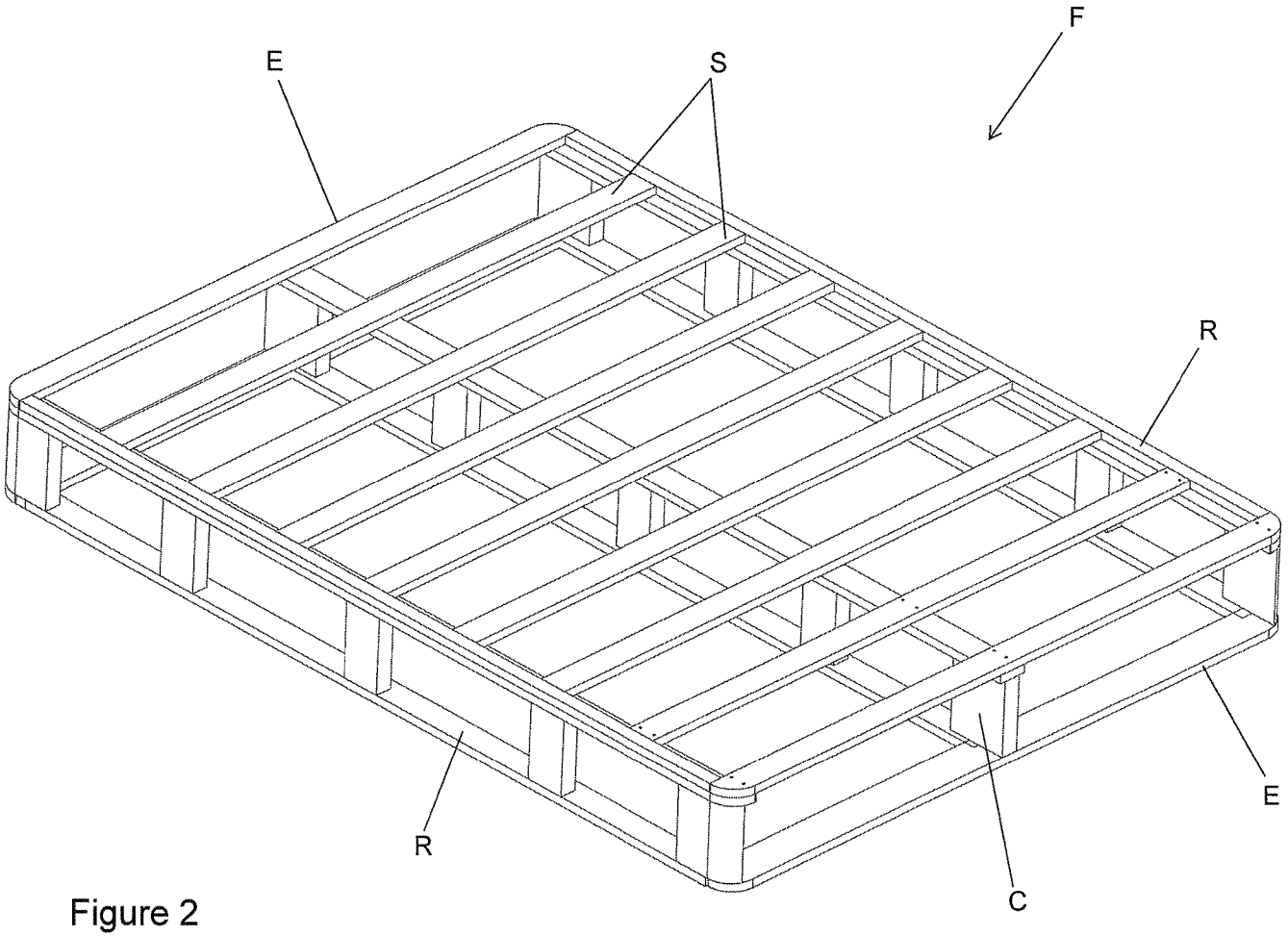
Figure 2 PRIOR ART
FIG. 2 shows a perspective view of a conventional bed foundation.
Figure 3:
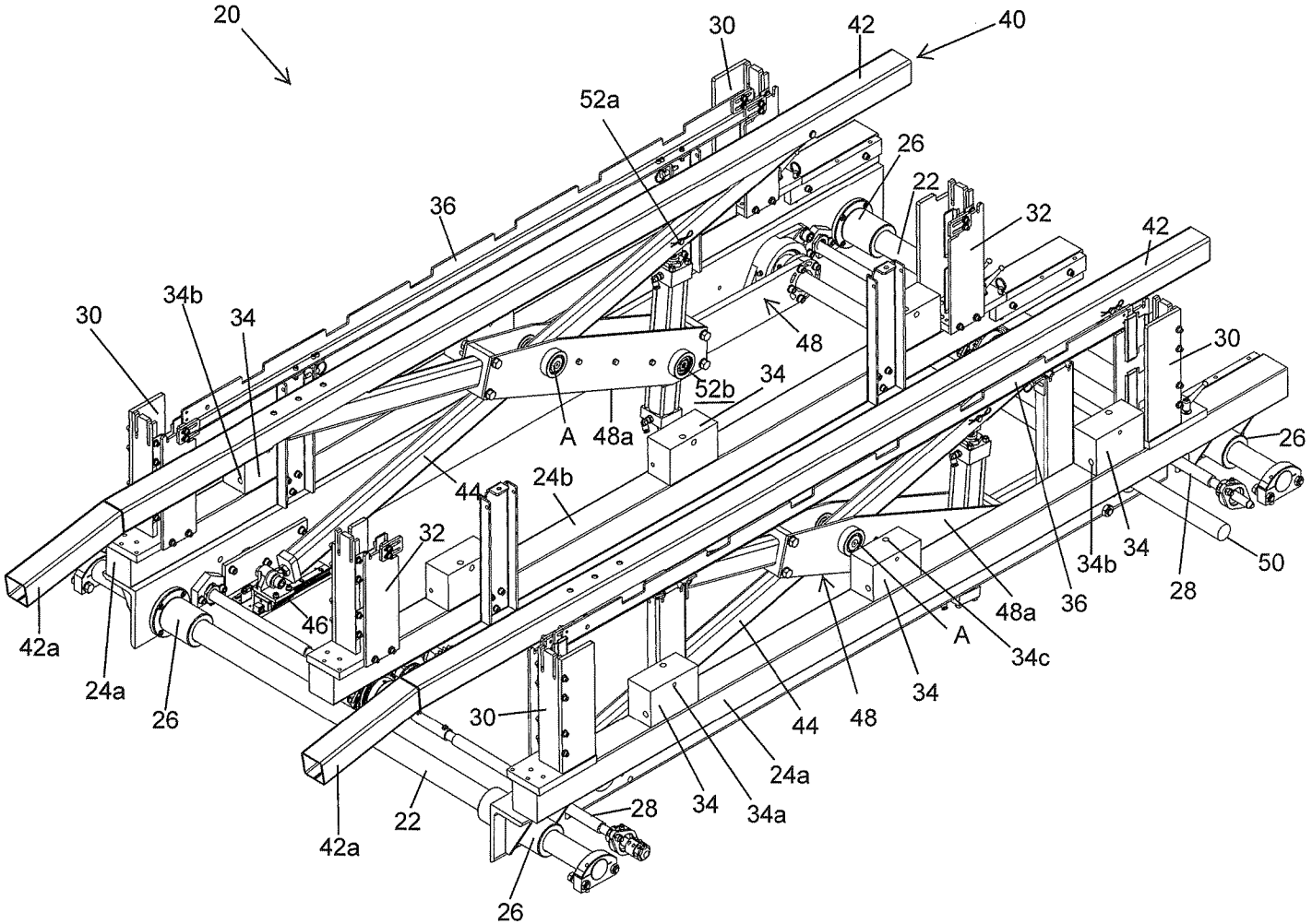
FIG. 3 shows a perspective view of a fixture for holding a bed foundation of the system of FIG. 1.
Figure 3A:
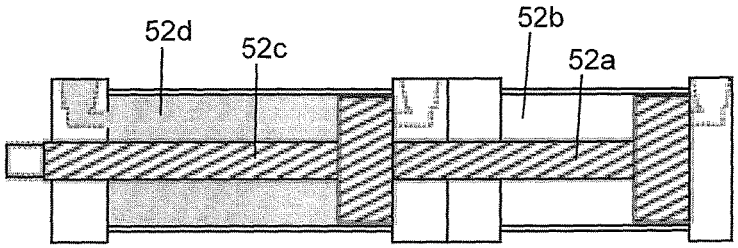
FIGS. 3A-3C show diagrammatic views of a pneumatic cylinder of the fixture of FIG. 3.
Figure 3B:
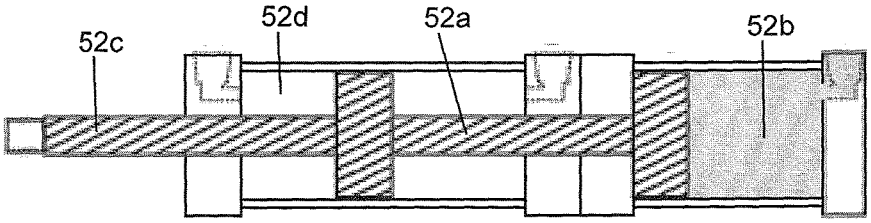
Figure 3C:
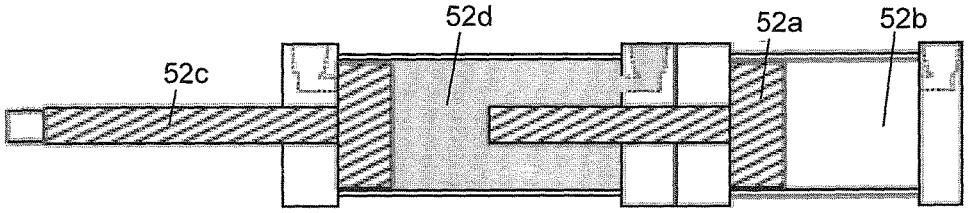
Figure 4:
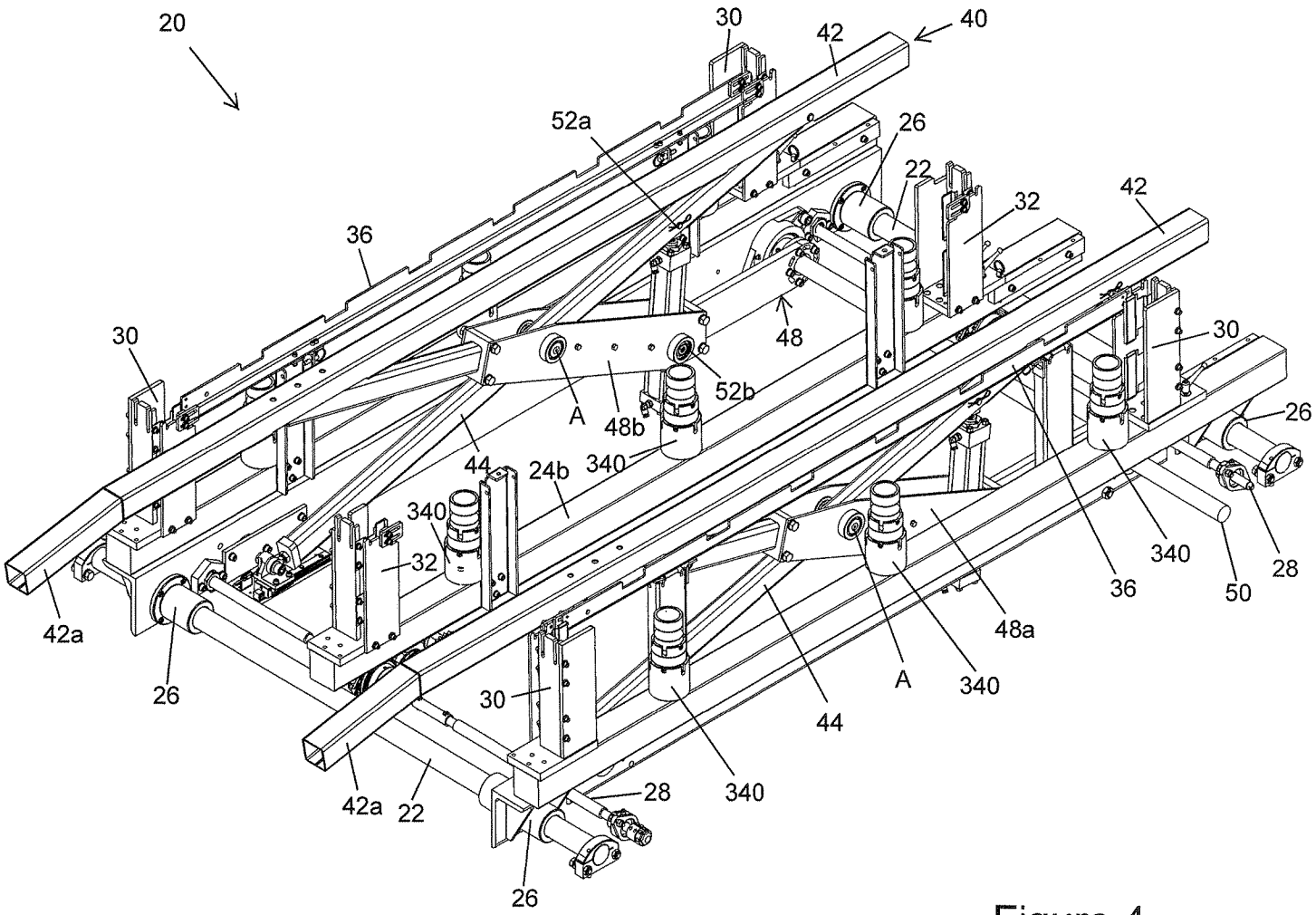
FIG. 4 shows a perspective view of a fixture of an alternate form for holding a bed foundation of the system of FIG. 1.

All figures are drawn for ease of explanation of the basic teachings of the present invention only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

A system for fastening bed foundations F is shown in the drawings and generally designated 10. Generally, system 10 includes a system frame 12 including first and second braces shown as side tubes 14, first and second end tubes 16 extending generally perpendicularly between opposite ends of side tubes 14, and pedestals 18.

System 10 generally includes a fixture 20 extending to a fixture height above system frame 12 for holding components to be fastened, and, in the form shown, bed foundations F. Generally, fixture 20 includes linear bearing shafts 22 extending generally perpendicularly between side tubes 14 of system frame 12 in a spaced parallel relation. First and second support beams 24*a* are movably supported by linear bearings 26 slideably receiving linear bearing shafts 22. A center support beam 24*b* is located intermediate and equally spaced between support beams 24*a* and extends between and is fixed to end tubes 16. Support beams 24*a* are driven to simultaneously move toward and away from support beam 24*b*. In the illustrated form, adjustment shafts 28 are rotatably mounted between side tubes 14 and are threadably engaged in support beams 24*a*. Thus, rotating adjustment shafts 28 in one direction causes support beams 24*a* to move away from each other and from support beam 24*b*, and rotating shafts 28 in the opposite direction causes support beams 24*a* to move toward each other and toward support beam 24*b*. Suitable provisions such as a drive chain can be provided so that rotation of one adjustment shaft 28 causes an equal amount of rotation of the other adjustment shaft 28.

Fixture 20 further includes compression squaring corners 30 at opposites ends of support beams 24*a* for slideably receiving the corners of the component to be fastened, and, in the form shown, between side rails R and end rails E of bed foundation F. Squaring elements 32 are also located at opposite ends of support beam 24*b* for receiving end rails E of bed foundation F. In the illustrated form, squaring corners 30 and squaring elements 32 at one end of fixture 20 are adjustably, slideably mounted to support beams 24*a* and 24*b* to allow adjustment to match the longitudinal length of bed foundation F. Fixture 20 further includes adjustable spacers shown as depth control elements 34 located on support beams 24*a* and 24*b* intermediate and spaced from squaring corners 30 and squaring elements 32 and having an adjustable height or extent when located on support beams 24*a* and 24*b* intermediate the fixture height and frame 12 to correspond to the depth of and to abut with bed foundation F held in fixture 20. In the form illustrated, depth control elements 34 can be connected to support beams 24*a* and 24*b* in different orientations corresponding to the height of side and center rails R and C of bed foundation F. Particularly, depth control elements 34 are shown being of a right parallelepiped in shape including a front and back of a rectangular shape having a length and height with a first securement aperture 34*a* extending therebetween, first and second ends of a rectangular shape having the length and a width with a second securement aperture 34*b* extending therebetween, and a top or first side and a bottom or second side of a rectangular shape having the length and the width with a third securement aperture 32*c* extending therebetween. The length is greater than the height which is greater than the width. Thus, by abutting the bottom, one end, or the front with support bars 24*a*, the upper surface of depth control element 34 will have a different spacing from support bars 24*a*.

Slat locators 36 are removably connected between squaring corners 30 of each support beam 24*a*. Suitable provisions for removably connecting slat locators 36 are provided to allow interchanging slat locators 36 to the particular longitudinal length of bed foundation F and/or the number and positioning of slats S in bed foundation F.

Fixture 20 further includes a lift mechanism 40 providing first and second slide bars 42 each terminating in a sloped exit 42*a*, with first and second slide bars 42 moveable between a fastening position at or below the fixture height and a lifting position greater than the fixture height for lifting and raising bed foundation F after being fastened from fixture 20. In the form illustrated, a first link 44 has a first end pivotably connected to and adjacent a first end of slide bar 42 and second end slideably mounted to support beam 24*a* by a slide mechanism 46. A second link 48 has a first end pivotably connected adjacent a rear end of slide bar 42 and second end pivotably mounted to a respective support beam 24*a* by a shaft 50 extending between and connected to the second ends of second links 48 for slide bars 42 and suitably rotatably mounted in support beams 24*a*. First and second links 44 and 46 are pivotably mounted together about an axis A.

Suitable provisions are provided for pivoting links 44 and 46 relative to each other. In the form illustrated, a pneumatic, three position, cylinder 52 has its outer piston end pivotably mounted to link 44 about axis 52*a* and has its cylinder portion pivotably mounted to link 48 about axis 52*b*. In particular, cylinder 52 includes an inner piston 52*a* movable in a first chamber 52*b* and an outer piston 52*c* movable in a second chamber 52*d* in linear alignment with piston 52*a*. Piston 52*a* includes outer piston end pivotably mounted to link 44. Thus, when pistons 52*a* and 52*c* were both retracted, outer piston end is in a retracted position. When piston 52*a* is actuated, piston 52*a* will abut and push piston 52*c* to extend for a distance corresponding to the linear length of first chamber 52*b*. When piston 52*c* is actuated, piston 52*c* will extend for a distance corresponding to the linear length of second chamber 52*d*. In the form shown, first chamber 52*b* has a linear length shorter than second chamber 52*d*.

In the form illustrated, link 48 includes a channel 48*a* having upper and lower openings. First link 44 and axis A extend through channel 48*a*, with axis 52*b* extending through channel 48*a* spaced from axis A and located intermediate the ends of the cylinder portion of hydraulic cylinder 52. Thus, expansion or retraction of pneumatic cylinder 52 causes links 44 and 48 to pivot relative to one another, with the second end of second link 48 rotating relative to support beam 24*a* and the second end of first link 44 sliding relative to support beam 24*a*, to raise or lower slide beams 42 relative to squaring corners and elements 30 and 32, depth control elements 34 and slat locators 36. It should also be appreciated that since lift mechanism 40 is mounted to support beams 24*a*, adjustment of the spacing between slide bars 42 is simultaneously adjusted when support beams 24*a* are adjusted utilizing adjustment shafts 28.

Figure 5:
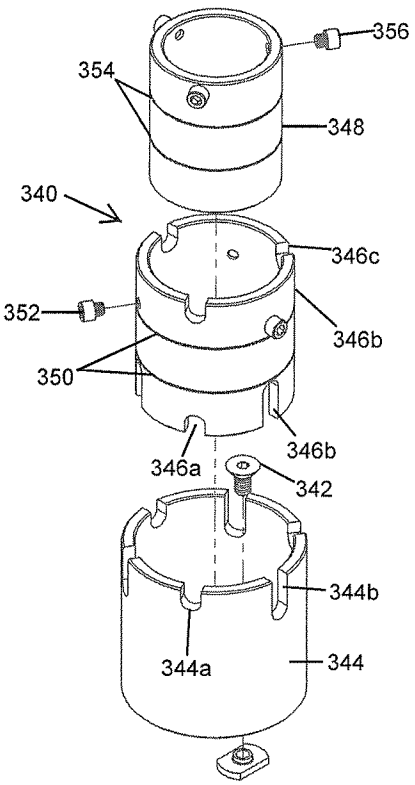
FIG. 5 shows an exploded perspective view of a depth control element of the fixture of FIG. 4.
Figure 5D:
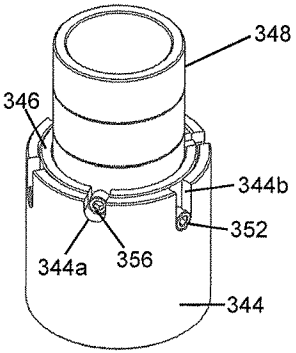
FIGS. 5A-5F show perspective views of the depth control element of FIG. 5 in various positions.
Figure 5A:
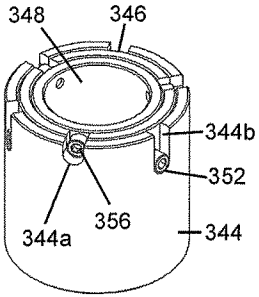
Figure 5E:
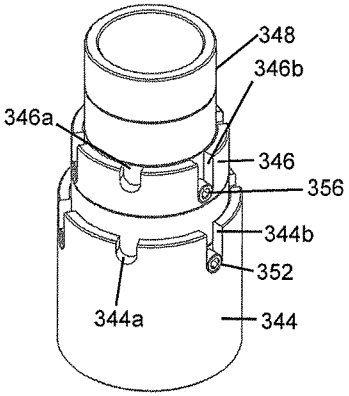
Figure 5B:
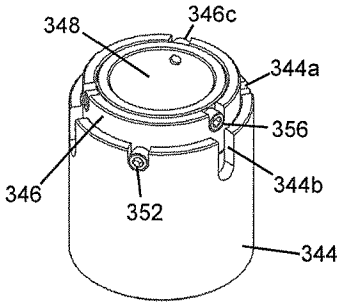
Figure 5F:
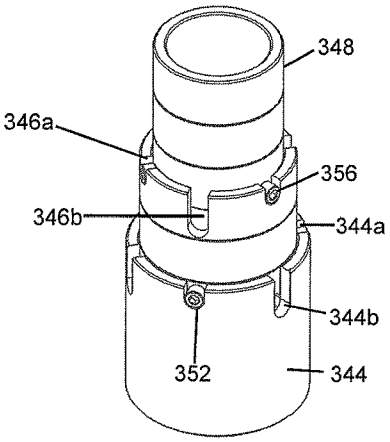
Figure 5C:
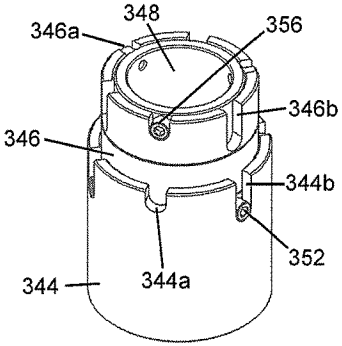
Figure 6:
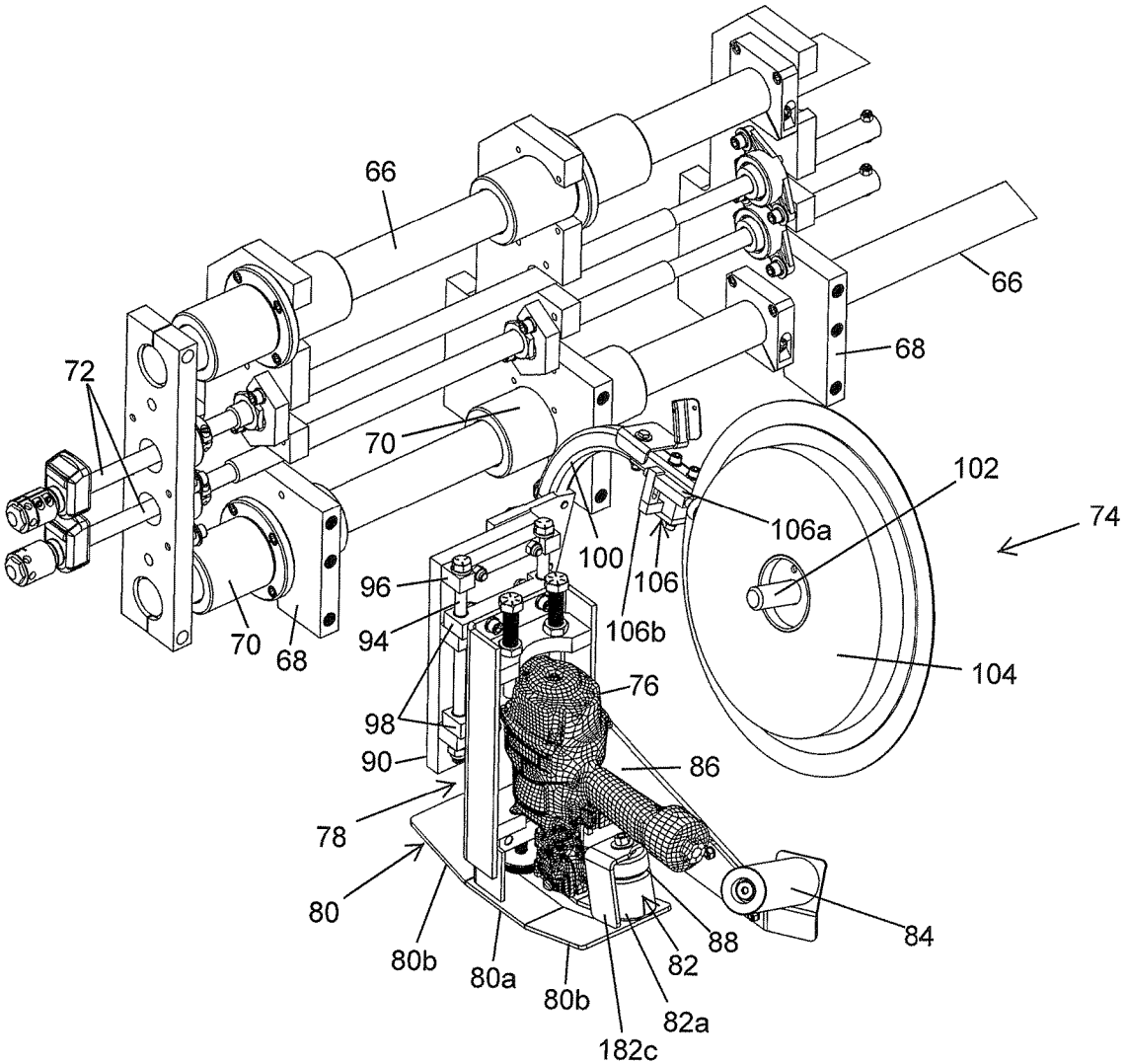
FIG. 6 shows a partial, exploded perspective view of a carriage of the system of FIG. 1.
Figure 7:
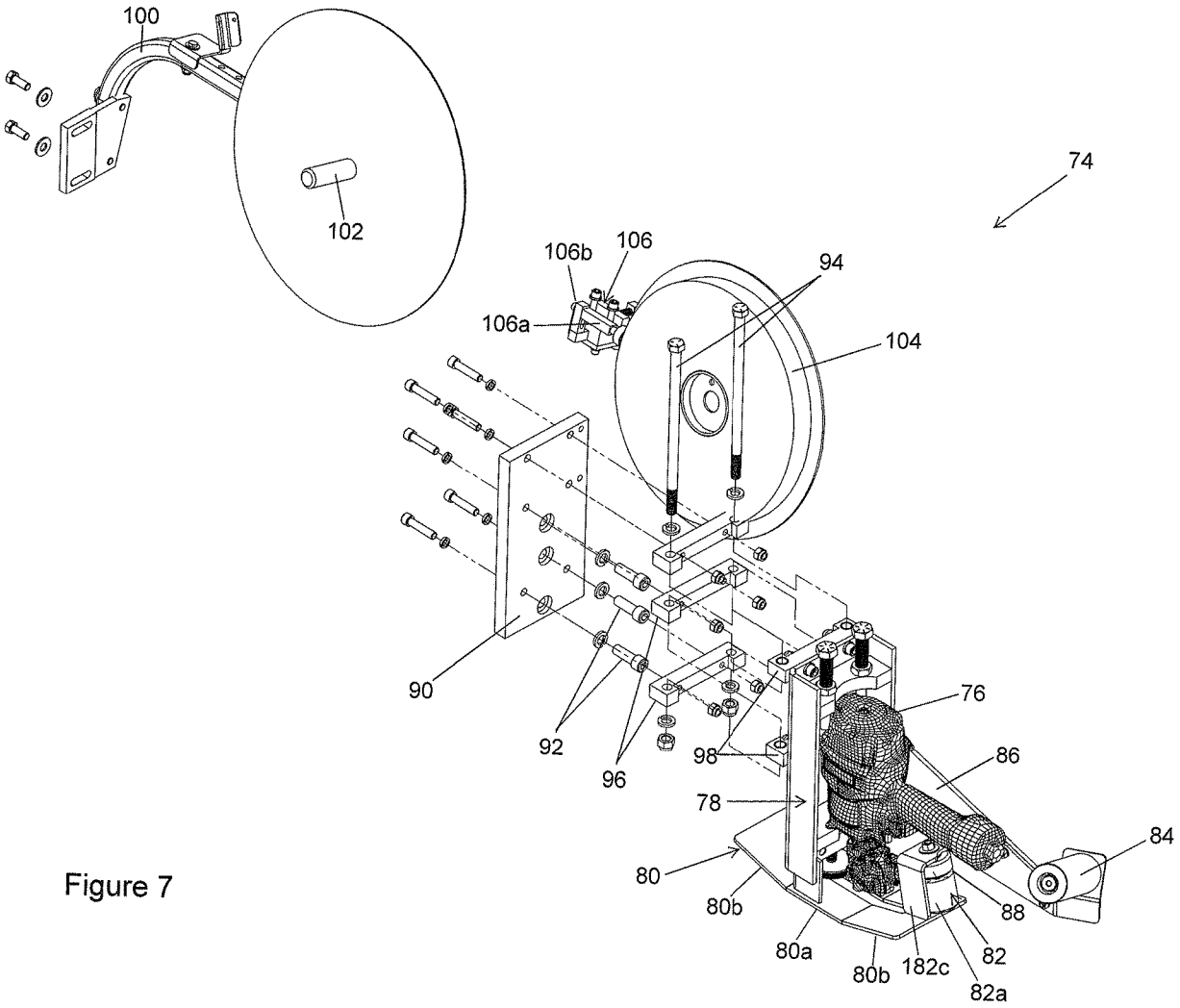
FIG. 7 shows an exploded perspective view of a nail gun assembly of the system of FIG. 1.
Figure 8:
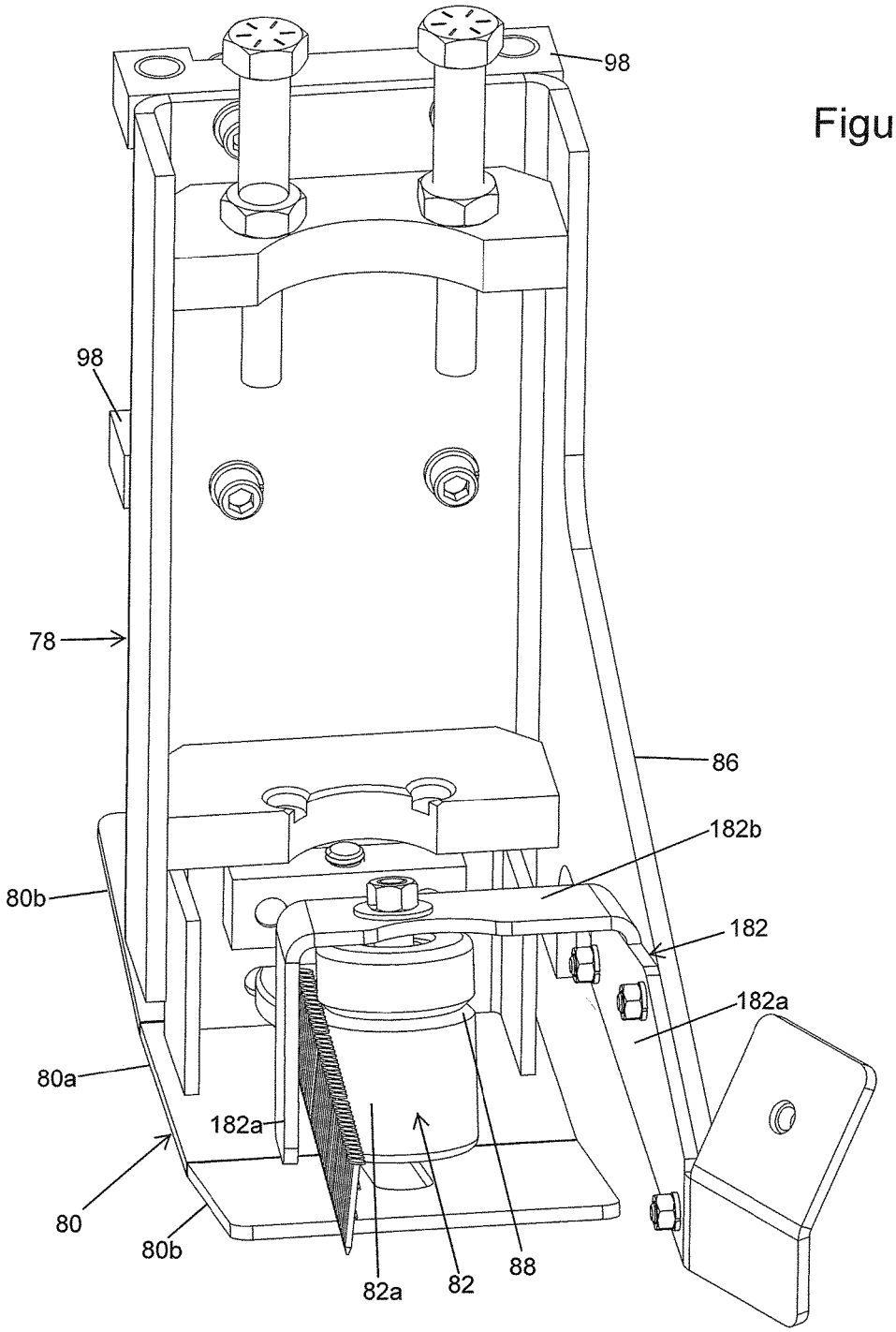
FIG. 8 shows a perspective view of the nail gun assembly of FIG. 7 with portions removed to show constructional details.
Figure 9:
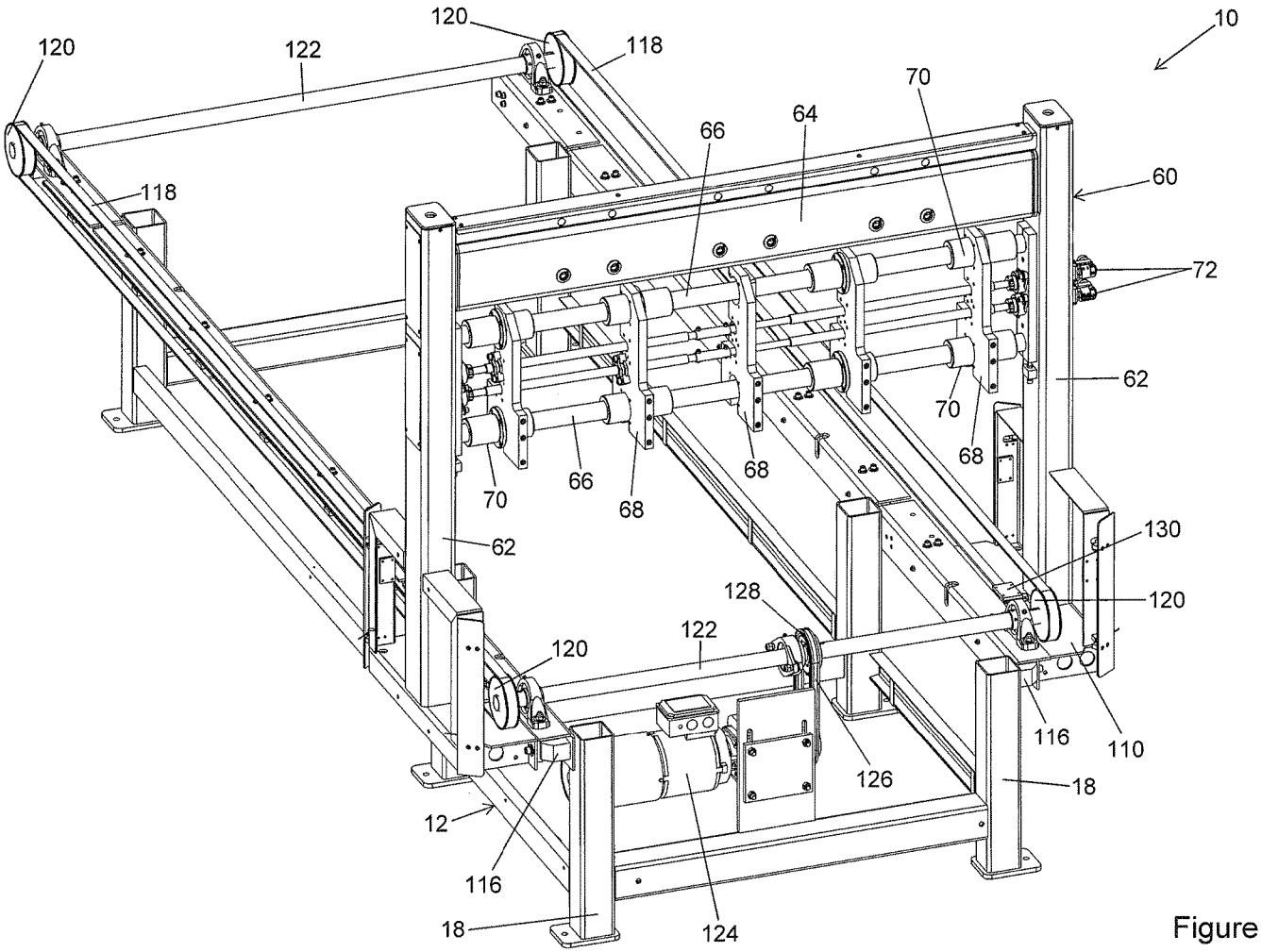
FIG. 9 shows a perspective view of the system of FIG. 1 with portions removed to show constructional details.
Figure 10:
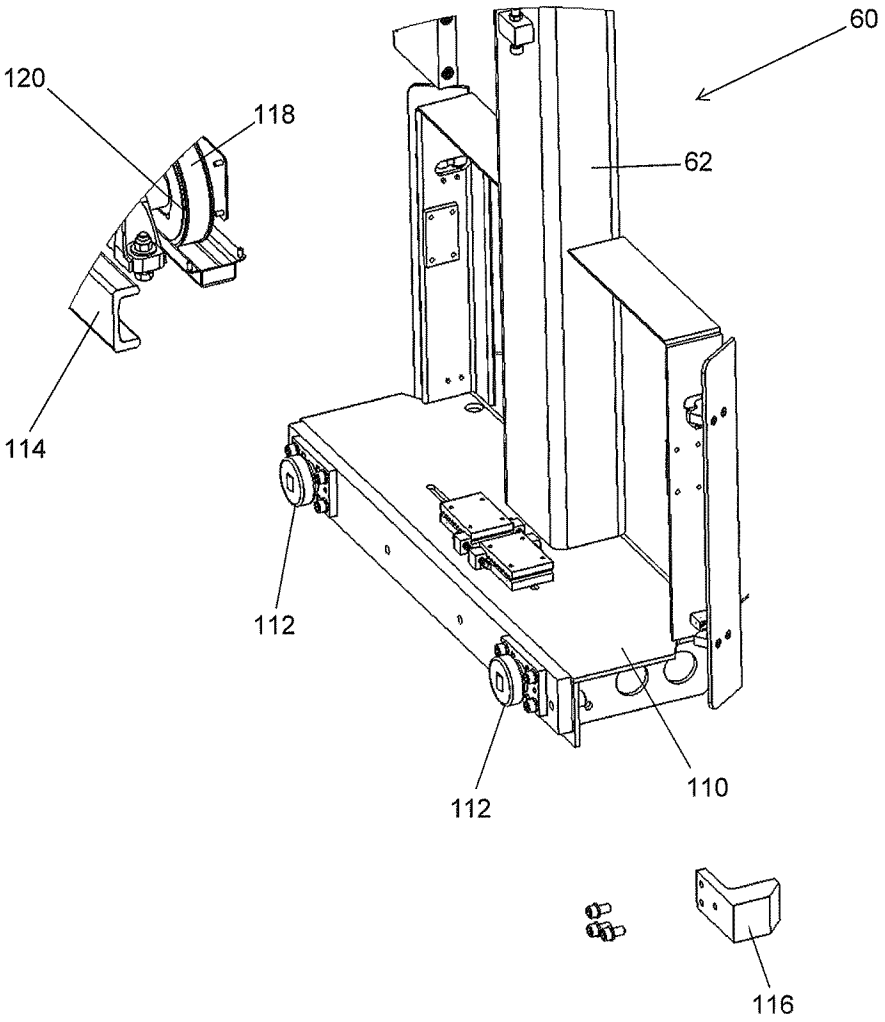
FIG. 10 shows a partial, exploded perspective view of the system of FIG. 1.
Figure 11:
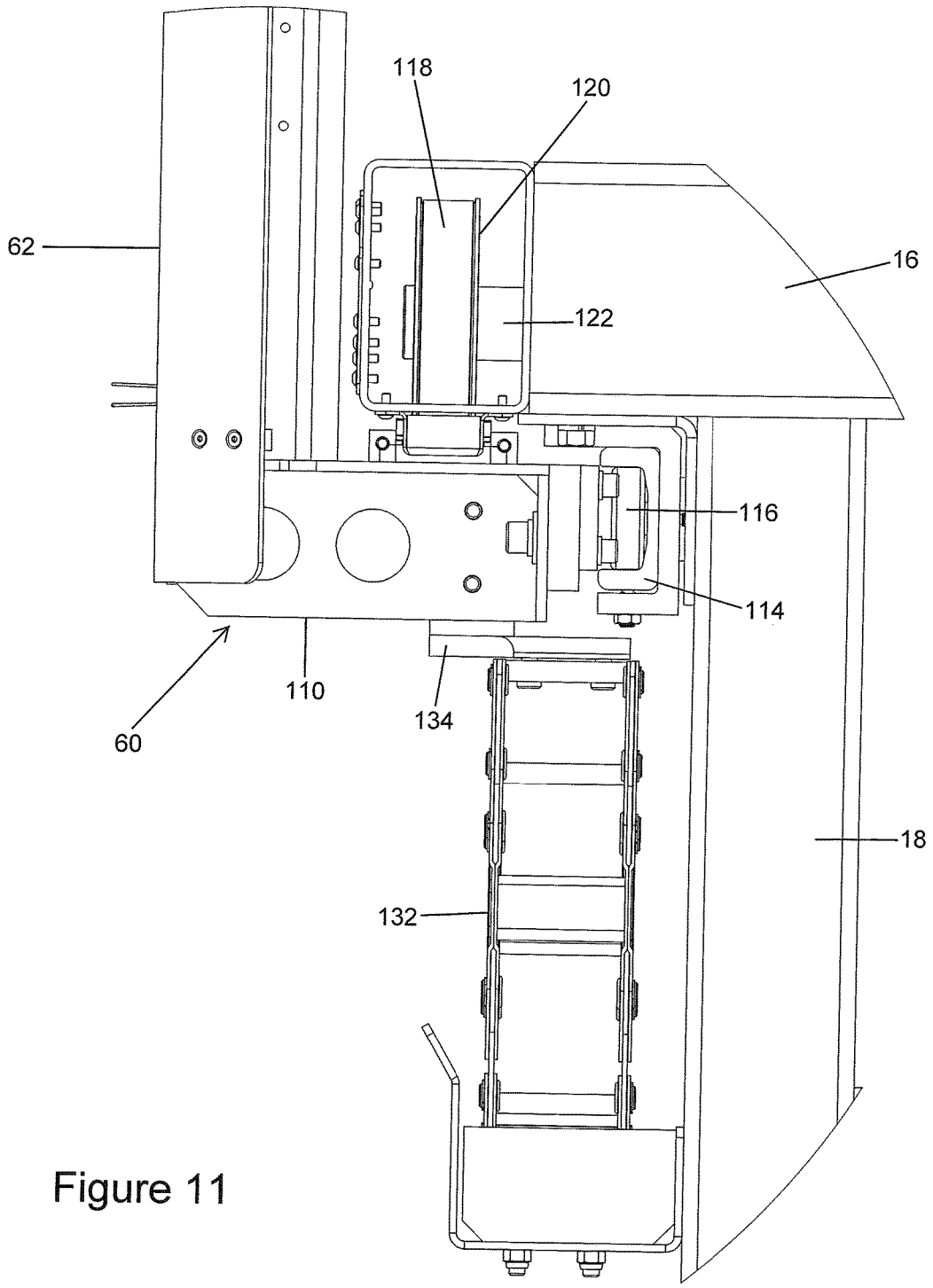
FIG. 11 shows a partial, cross-sectional view of the system of FIG. 1.

In an alternate form, adjustable spacers shown as depth control elements 340 can be connected to support beams 24*a* and 24*b* by suitable fasteners 342. Particularly, depth control elements 340 include first, second, and third pillars shown as cylindrical components 344, 346 and 348 shown as having annular and, in particular, circular cross sections, with component 346 slideably and telescopically received in component 344 and with component 348 slideably and telescopically received in component 346. Component 344 includes an open top and a closed bottom through which fastener 342 extends. Sets of slots 344*a* and 344*b* extend axially from the top edge of component 344, with each set extending to the same depth but different than the other set. Component 346 includes open first and second ends, with sets of slots 346 and 346*b* extending axially from the second end and with a set of slots 346*c* extending axially from the first end, with each set extending to the same depth but different than the other set. The outer circumference of component 346 includes spaced, parallel, annular indents 350. Component 346 further includes a set of protrusions 352 threadably received and extending radially outwardly to a radial extent generally equal to the radial extent of component 344. Component 348 includes open first and second ends and spaced, parallel, annular indents 354 on its outer circumference. Component 348 further includes a set of protrusions 356 threadably received and extending radially outwardly to a radial extent generally equal to the radial extent of component 346. Protrusions 352 and 356 have circumferential spacings corresponding to and for receipt in slots 344*a* and 344*b* and slots 346*a*, 346*b* and 346*c*. Additionally, component 346 is slideably received in component 344 with either the first or second end facing the closed end of component 344, and component 348 is slideably received in component 346 with either the first or second end facing the closed end of component 344. Thus, if protrusions 352 having an axial extent from the first end of component 346 equal to and for receipt the axial depth of slots 344*b* with the second end closest to the closed end of component 344 and if protrusions 356 having an axial extent from the first end of component 348 equal to and for receipt in slots 346*c* with the second end closest to the closed end of component 344, the combined height as shown in FIG. 5A of depth control element 340 is equal to that of component 344. Similarly, if protrusion 352 is received in slots 344*a* with the second end closest to the closed end of component 344 and if protrusions 356 having an axial extent from the first end of component 348 equal to and for receipt in slots 346*c* with the second end closest to the closed end of component 344, the combined height as shown in FIG. 5B of depth control element 340 is greater than that of component 344. If protrusions 352 are received in slots 344*b* with the first end closest to the closed end of component 344 and if protrusions 356 having an axial extent from the first end of component 348 equal to and for receipt in slots 346*a* with the second end closest to the closed end of component 344, the combined height of depth control element 340 as shown in FIG. 5C is greater than that of FIG. 5B. If protrusions 352 are received in slots 344*b* with the second end closest to the closed end of component 344 and if protrusions 356 are received in slots 346*a* with the first end closest to the closed end of component 344, the combined height of depth control element 340 as shown in FIG. 5D is greater than that of FIG. 5C. If protrusions 352 are received in slots 344*b* with the first end closest to the closed end of component 344 and if protrusions 356 are located in slots 346*b* with the first end closest to the closed end of component 344, the combined height of depth control element 340 as shown in FIG. 5E is greater than that of FIG. 5D. If protrusions 352 are received in slots 344*b* with the first end closest to the closed end of component 344*d* and if protrusions 356 are received in slots 346*a* with the first end closest to the closed end of component 344*d*, the combined height of depth control element 340 as shown in FIG. 5F is greater than that of FIG. 5E.

System 10 further includes a nail gun carriage 60 movably mounted to and along side tubes 14 of system frame 12 and moveable between a first position extensive with fixture 20 and a second position beyond fixture 20. Carriage 60 includes first and second vertical posts 62 extending generally perpendicular to system frame 12 with a hollow air reservoir 64 interconnected therebetween spaced from and parallel to system frame 12. Carriage 60 further includes first and second linear bearing shafts 66 extending generally perpendicularly between vertical posts 62 in a spaced parallel relation. Mounts 68 are movably supported by linear bearings 70 slideably receiving linear bearing shafts 66. Mounts 68 on the respective linear bearing shafts 66 are driven to simultaneously move toward and away from vertical posts 62. In the illustrated form, first and second adjustment shafts 72 are rotatably mounted between posts 62 and are threadably mounted to corresponding mounts 68. Thus, rotating adjustment shafts 72 in one direction causes mounts 68 to move toward each other and away from posts 62, and rotating adjustment shafts 72 in an opposite direction causes mounts 68 to move away from each other and toward posts 62.

A nail gun assembly 74 is carried by and between vertical posts 62 by being slideably mounted to each mount 68 and in the form shown at a consistent height relative to system frame 12 when moving in and between the first and second positions. In the form shown, assembly 74 includes a conventional nail gun 76 which is suitably mounted in a holder 78 having a skid plate 80. Skid plate 80 includes a center portion 80*a* which is generally planar and parallel to system frame 12 and through which nails pass from nail gun 76. Wing portions 80*b* extend at a small acute angle in the order of 15 degrees and on opposite ends of center portion 80*a*. A roller 82 is rotatably mounted relative to one wing portion 80*b* about an axis perpendicular to wing portion 80*b* and a small acute angle in the order of 2.1 degrees from vertical. A further roller 84 is mounted to the outward end of an arm 86 projecting from holder 78. In the form shown, roller 82 includes a circumferential V-shaped groove 88 extending radially inward of a cylindrical outer surface 82*a* thereof. Roller 82 is mounted to a U-shaped roller bracket 182 including a first leg 182*a* suitably secured to arm 86 intermediate and spaced from roller 84 and holder 78. Roller 82 is rotatably mounted about an axis to a tab in the form of a second leg 182*b* integrally extending from first leg 182*a* in the same direction away from arm 86 as roller 84. A flat board shown in the form of a third leg 182*c* integrally extends downward from second leg 182*b* generally parallel and tangential to but spaced from outer surface 82*a*, with the distance between third leg 182*c* and the bottom of V-shaped groove 88 being generally equal to and for receiving a head of a nail to be driven by nail gun 76 when the shank of the nail extends between outer surface 82*a* and third leg 182*c*. It should be appreciated that third leg 182*c* provides a stationary, metal-to-metal, plane of contact for the nails as opposed to a line of contact which would be provided by a pair of rollers to hold and guide the nails to nail gun 76. Roller 82 is located intermediate and spaced from roller 84 and center portion 80*a* in a direction parallel to system frame 12. Roller 84 is rotatably mounted about an axis at an obtuse angle in the order of 139 degrees to vertical away from system frame 12 and at an acute in the order of 63 degrees away from linear bearing shafts 66.

A support plate 90 is suitably connected to mount 68 such as by fasteners 92. Slide shafts 94 are mounted vertically in a spaced parallel relation to support plate 90 by spaced parallel brackets 96 suitably secured to support plate 90. Holder 78 is suitably slideably mounted to support plate 90 and slide shafts 94 such as by brackets 98 located intermediate brackets 96 and through which slide shafts 94 slideably pass. A reel support 100 is suitably secured such as to support plate 90 and extends in a plane extending generally perpendicular to linear bearing shafts 66 at an acute angle of 15 degrees from vertical and slide shafts 94 and at an obtuse angle of 105 degrees from horizontal and linear bearing shafts 66. A reel axis shaft 102 extends at an acute angle in the order of 15 degrees to horizontal and center portion 80 and to system frame 12 in a plane extending parallel to linear bearing shafts 66. Reel axis shaft 102 extends at an acute angle in the order of 30 degrees to roller 84. Reel axis shaft 102 is intermediate rollers 82 and 84 in a direction parallel to system frame 12, and roller 84 is intermediate roller 82 and reel axis shaft 102 in a direction perpendicular to system frame 12. A nail belt drum 104 is rotatably mounted to reel axis shaft 102 to which tension is applied by a tensioner 106. In particular, tensioner 106 includes a plunger 106*a* which is slideably biased to a body 106*b* towards and engaging with an outer circumference of nail belt drum 104. The bias of plunger 106*a* is adjustable to require a tensional force by the nail belt of a spool of nails carried by the nail belt drum 104 to result in rotation and unwinding of the spool of nails.

Each vertical post 62 upstands from a platform 110 adjacent to its outer vertical edge and which is generally parallel to and outside of system frame 12. First and second support wheels 112 are rotatably mounted to an inner vertical edge of platform 110 about axes parallel to system frame 12 and generally perpendicular to side tubes 14 thereof. Wheels 112 are received in a U-shaped channel 114 suitably secured to system frame 12 with the legs thereof parallel to system frame 12 and the interconnecting portion thereof facing pedestals 18. Hard stops 116 can be secured to system frame 12 and extend over the ends of U-shaped channel 114 to prevent support wheels 112 from leaving U-shaped channel 114 in directions parallel to side tubes 14. The rigidity of posts 62 and hollow air reservoir 64 in fluid communication with nail guns 76 and linear bearing shafts 66 secured therebetween prevent support wheels 112 from moving outwardly of U-shaped channel 114 in a direction perpendicular to side tubes 14. Thus, carriage 60 is movably mounted to system frame 12 and relative to fixture 20 for movement in a direction parallel to side tubes 14.

Suitable provisions are provided for moving carriage 60 relative to system frame 12. In the form shown, first and second endless belts 118 extend between pulleys 120 of first and second shafts 122 adjacent end tubes 16 of system frame 12. One shaft 122 is driven by an electric motor 124 such as by a belt 126 extending around a pulley 128 secured to shaft 122. Belts 118 are secured to carriage 60 shown as being clamped by sandwich type clamps 130 mounted to platform 110. Thus, as shaft 122 is driven by electric motor 124, belts 118 are driven with carriage 60 moving with belts 118 due to the securement by clamps 130. One end of a flexible cable carrier 132 is secured to a hanger 134 secured to platform 110 opposite to clamps 130 and vertical posts 62. Carrier 132 extends from hanger 134 rearwardly away from fixture 20 to a C-shaped portion and then to an elongated portion parallel to the side frame 14 to an opposite end connected to system frame 12, with the distance of hanger 134 to the C-shaped portion increasing as carriage 60 moves towards sloped exit 42*a* of slide bars 42. Carrier 132 can be any conventional design for containing air and/or electrical feed lines. It should be appreciated that carriage 60 allows mounting of belts 126 and flexible carrier 132 generally in a vertically spaced relation on opposite sides of platform 110 with the belt 126 and the center of flexible carrier located laterally outward of wheels 116 and laterally inward of posts 62 allowing the longitudinal length of carriage 60 to be reduced as well as insuring that posts 62 remain vertical relative to system frame 12.

Fastening system 10 as shown and described includes several aspects which are believed to produce synergistic results especially in connection with fastening bed foundations F. However, it should be appreciated that some or all aspects of fastening system 10 has application to fastening other types and forms of components. Furthermore, it should be appreciated that some or all aspects of fastening system 10 can be used solely or in other combinations than described in similar or other types of fastening systems. Additionally, although fasteners are shown as being nails, fastening system 10 can be utilized with other types of fasteners, such as, but not limited to, staples, and nail guns referenced to herein, should be considered any type of device which drives or installs the particular type of fastener being utilized.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A fastening system comprising, in combination: a frame; a fixture mounted on the frame, with the fixture including squaring corners extending to a fixture height above the frame and oriented to hold a component to be fastened; a nail gun carriage moveably mounted to the frame and movable between a first position extensive with the fixture and a second position beyond the fixture; a nail gun carried by the nail gun carriage at a consistent height relative to the frame and greater than the fixture height; and an adjustable spacer mounted on the frame and having an adjustable height intermediate the fixture height and the frame and oriented to abut the component held in the fixture, wherein the adjustable spacer includes a body including a front, a back, and first and second sides extending between the front and the back with a height between the front and the back being different than a width between the first and second sides, with one of the front, the back and the first and second sides abutting with the frame and the body further includes first and second ends extending between the front and the back and the first and second sides, with a length between the first and second ends being different than the height and the width, with one of the front, the back, the first and second sides and the first and second ends abutting with the frame wherein each of the front, the back, the first and second sides and the first and second ends are planar and the body is of a right parallelepiped shape.

2. The fastening system of claim 1, wherein the adjustable spacer comprises a first pillar and a second pillar slideably connected to the first pillar along a slide direction, wherein the first pillar includes a protrusion extending generally perpendicular to the slide direction, with the second pillar including first and second slots extending parallel to the slide direction from an end of the second pillar, with the first and second slots being of a size for slideable receipt of the protrusion, with the first slot having a first depth from the end of the second pillar, and with the second slot having a second depth from the end of the second pillar different than the first depth.

3. The fastening system of claim 2, wherein the end of the second pillar includes a first end and a second end opposite to the first end in the slide direction, with the first slot extending from the first end and the second slot extending from the second end.

4. The fastening system of claim 2, wherein the end of the second pillar includes a first end and a second end opposite to the first end in the slide direction, and wherein the first and second slots extend from the first end.

5. The fastening system of claim 4, wherein the first and second pillars have annular cross sections, with the second pillar being slideably connected with the first pillar by being telescopically received in the first pillar.

6. The fastening system of claim 5, wherein the adjustable spacer further comprises a third pillar slideably connected to the second pillar along the slide direction, wherein the second pillar includes a protrusion extending generally perpendicular to the slide direction, with the third pillar including a slot extending parallel to the slide direction from an end of the third pillar, with the slot of the third pillar being of a size resulting from slideable receipt of the portion of the second pillar.

7. The fastening system of claim 6, wherein the third pillar has annular cross sections, with the third pillar being slideably connected with the second pillar by being telescopically received in the second pillar, with the protrusion of the first pillar having an extent equal to or less than an inner diameter of the third pillar.

8. Fastening system comprising, in combination: a system frame including first and second side braces; first and second support beams moveably supported between the first and second side braces to move toward and away from each other; corners at opposite ends of each of the first and second support beams and adapted to receive a component to be fastened; first and second slide bars located intermediate and parallel to the first and second support beams and moveably mounted to the first and second support beams and moveable relative to the corners of the first and second support beams and adapted to raise the component to be fastened received in the corners; a nail gun carriage moveably mounted to the system frame and moveable between a first position between the corners and a second position beyond the first and second slide bars; and a nail gun carried by the nail gun carriage at a consistent height relative to the system frame and greater than the corners.

9. The fastening system of claim 8, wherein each of the first and second support beams include linear bearings, with the linear bearings slideably receiving linear bearing shafts extending between the first and second side braces to movably support the first and second support beams to the first and second side braces; and wherein adjustment shafts are rotatably mounted between the first and second side braces and are threadably engaged in the first and second support beams, with rotating the adjustment shafts in one direction simultaneously moving the first and second support beams towards each other and rotating the adjustments opposite to the one direction simultaneously moving the first and second support beams away from each other.

10. The fastening system of claim 9, wherein each of the first and second slide bars has first and second ends, wherein each slide bar includes a first link having a first end pivotably connected to and adjacent the first end of the slide bar and a second end pivotably mounted to a slide mechanism slideably mounted to a corresponding support beam, wherein each slide bar has a second link having a first end pivotably connected to the second end of the slide bar and a second end pivotably mounted to the corresponding support beam opposite to the slide mechanism, with the first and second links pivotably mounted together about an axis spaced intermediate the first and second ends of the first and second links, with the first and second links being pivoted to move the first and second slide bars relative to the corners.

11. The fastening system of claim 10, wherein the second ends of the first and second links are pivotally connected together by a shaft extending between and rotatably mounted in the first and second support beams; and wherein a cylinder has a piston end pivotably connected to the first links and a cylinder portion pivotably mounted to the second link, with expansion or retraction of the cylinder pivoting the first and second links relative to each other.

12. A fastening system comprising, in combination: a system frame including first and second U-shaped channels having spaced, parallel first and second legs; a fixture mounted to the system frame and adapted to hold a component to be fastened; a carriage including first and second platforms having inner and outer vertical edges parallel to and outside the system frame, with each platform including a wheel rotatably mounted to the inner vertical edge and received between the first and second legs, with a vertical post extending from each platform adjacent the outer vertical surface, with the carriage being moveable relative to the system frame between a first position extensive with the fixture and a second position beyond the fixture; a nail gun carried by and between the vertical posts of the first and second platforms; a hanger connected to the first platform opposite to the vertical post; a flexible cable carrier having a first end secured to the hanger and a second end secured to the system frame, with the flexible cable carrier having a C-shaped portion extending from the hanger and an elongated portion parallel to the system frame, with a distance of the C-shaped portion from the hanger changing with movement of the carriage; and cables carried by the flexible cable carrier and connected to the nail gun; and first and second endless belts located on and clamped to the first and second platforms, outside the system frame, inside the vertical posts of the first and second platforms, and extending between pulleys of first and second shafts, with the first shaft being driven, with the first platform being intermediate the hanger and the first belt.

13. The fastening system of claim 12, wherein the carriage includes an air reservoir connected to and extending between the vertical posts of the first and second platforms, with the air reservoir in fluid communication with the nail gun, with the air reservoir preventing the wheels of the first and second platforms from moving outwardly of the first and second legs of the first and second U-shaped channels.

14. The fastening system of claim 13, wherein the carriage further includes a linear bearing shaft connected to and extending between the vertical posts of the first and second platforms and includes a mount moveably supported by a linear bearing slideably receiving the linear bearing shaft, with the nail gun mounted to the mount; and wherein the carriage further includes an adjustment shaft rotatably mounted between the vertical posts of the first and second platforms and threadably mounted to the mount, with rotation of the adjustment shaft moving the mount and the nail gun mounted thereto relative to the first and second posts of the first and second carriages.

15. The fastening system of claim 14, wherein the nail gun includes a belt drum rotatably mounted to the mount, with the drum positioned to carry a spool of fasteners; and wherein the nail gun further includes a plunger slideably biased towards and engaging with an outer circumference of the belt drum to require a tensional force by the fastener belt to result in rotation of the belt drum.

16. The fastening system of claim 15, wherein the nail gun includes a roller having a circumferential V-shaped groove extending radially inward of a cylindrical outer surface thereof; wherein the roller is rotatably mounted about an axis to a tab of a roller bracket connected to the mount, with the roller bracket further including a flat board extending from the tab tangential to but spaced from the cylinder outer surface of the roller, with the drum positioned to carry the spool of fasteners in the form of nails having heads.

17. The fastening system of claim 16, wherein the nail gun includes a skid plate having a center portion which is planar, horizontal, and parallel to the system frame, wherein the axis of the roller being at a small acute angle in the order of 2.1 degrees from vertical; wherein the nail gun further includes another roller rotatably mounted about an axis at an obtuse angle in the order of 139 degrees to vertical away from the roller and at an acute angle in the order of 63 degrees away from the mount, with the other roller and the nail gun located intermediate the roller and the drum.

18. The fastening system of claim 17, further comprising a support plate connected to the mount; first and second vertical slide shafts mounted to the support plate, with the nail gun and a bracket slideably mounted to the slide shafts; a reel support secured to the support shaft, with the belt drum rotatably mounted to the reel support and with the plunger slideably mounted to the reel support, with the roller and the other roller rotatably mounted to the bracket.

19. Fastening system comprising, in combination: a system frame including first and second side braces; first and second support beams moveably supported between the first and second side braces to move toward and away from each other; squaring corners extending to a fixture height above the system frame at opposite ends of each of the first and second support beams and adapted to receive a component to be fastened; first and second slide bars located intermediate and parallel to the first and second support beams and moveably mounted to the first and second support beams and moveable relative to the corners of the first and second support beams and adapted to raise the component to be fastened received in the squaring corners; a nail gun carriage moveably mounted to the system frame and moveable between a first position between the corners and a second position beyond the first and second slide bars; a nail gun carried by the nail gun carriage at a consistent height relative to the system frame and greater than the squaring corners; and an adjustable spacer mounted on the frame and having an adjustable height intermediate the fixture height and the frame and adapted to abut the component held in the fixture, with the system frame including first and second U-shaped channels having spaced, parallel first and second legs facing outwardly, with the nail gun carriage including first and second platforms having inner and outer vertical edges parallel to and outside the system frame, with each platform including a wheel rotatably mounted to the inner vertical edge and received between the first and second legs, with a vertical post extending from each platform adjacent the outer vertical surface, with the nail gun mounted to and carried by a mount moveably supported between the vertical posts of the first and second platforms, wherein the nail gun includes a roller having a circumferential V-shaped groove extending radially inward of a cylindrical outer surface thereof, wherein the roller is rotatably mounted about an axis to a tab of a roller bracket connected to the mount, with the roller bracket further including a flat board extending from the tab tangential to but spaced from the cylindrical outer surface of the roller, wherein the nail gun includes a belt drum rotatably mounted to the mount, with the drum adapted to carry the spool of fasteners in the form of nails having heads, wherein a distance between a bottom of the circumferential V-shaped groove and the flat board is adapted to be equal to and arranged for receiving the heads of the nails, with the flat board adapted to providing a stationary contact plane for the nails, and wherein the nail gun further includes a plunger slideably biased towards and engaging with an outer circumference of the belt drum to require a tensional force by the fastener belt to result in rotation of the belt drum.

* * * * *